US010982382B2

(12) United States Patent
Murate et al.

(10) Patent No.: US 10,982,382 B2
(45) Date of Patent: Apr. 20, 2021

(54) NAPPED ARTIFICIAL LEATHER DYED WITH CATIONIC DYE, AND METHOD FOR MANUFACTURING THE SAME

(71) Applicant: KURARAY CO., LTD., Kurashiki (JP)

(72) Inventors: Yasunori Murate, Okayama (JP); Hitoshi Nakatsuka, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 93 days.

(21) Appl. No.: 15/558,331

(22) PCT Filed: Mar. 17, 2016

(86) PCT No.: PCT/JP2016/001560
§ 371 (c)(1),
(2) Date: Sep. 14, 2017

(87) PCT Pub. No.: WO2016/147671
PCT Pub. Date: Sep. 22, 2016

(65) Prior Publication Data

US 2018/0066397 A1 Mar. 8, 2018

(30) Foreign Application Priority Data

Mar. 17, 2015 (JP) ..... JP2015-053966

(51) Int. Cl.

| | |
|---|---|
| ***D06N 3/12*** | (2006.01) |
| ***D06N 3/14*** | (2006.01) |
| ***D06N 3/00*** | (2006.01) |
| ***D06P 3/00*** | (2006.01) |
| ***D06P 3/52*** | (2006.01) |

(52) U.S. Cl.
CPC ..... *D06N 3/123* (2013.01); *D06N 3/0004* (2013.01); *D06N 3/0011* (2013.01); *D06N 3/0036* (2013.01); *D06N 3/0065* (2013.01); *D06N 3/0075* (2013.01); *D06N 3/14* (2013.01); *D06P 3/002* (2013.01); *D06P 3/522* (2013.01); *D06N 2209/0807* (2013.01)

(58) Field of Classification Search
CPC ..... D06N 2209/0807; D06N 3/0004; D06N 3/0011; D06N 3/0036; D06N 3/0065; D06N 3/0075; D06N 3/123; D06N 3/14
See application file for complete search history.

(56) References Cited

U.S. PATENT DOCUMENTS 3,746,507 A * 7/1973 Browne ..... D06P 1/924 8/539
4,604,320 A * 8/1986 Okamoto ..... D01F 8/14 428/373

FOREIGN PATENT DOCUMENTS

| | | | | |
|---|---|---|---|---|
| EP | 0 084 203 | A1 | | 7/1983 |
| EP | 1 736 593 | A2 | | 12/2006 |
| JP | 61-70083 | A | | 4/1986 |
| JP | 6-192968 | A | | 7/1994 |
| JP | 2000-248427 | A | | 9/2000 |
| JP | 2001-19735 | A | | 1/2001 |
| JP | 2003027380 | A | * | 1/2003 |
| JP | 2003-193376 | A | | 7/2003 |
| JP | 2005-320647 | A | | 11/2005 |
| JP | 2010-242240 | A | | 10/2010 |
| JP | 2014-29050 | A | | 2/2014 |
| JP | 2014029050 | A | * | 2/2014 |

OTHER PUBLICATIONS

Gelanats Adhesion JIS L 1089 t-gelanots.com (accessed Feb. 7, 2020).*
International Search Report dated Jun. 14, 2016 in PCT/JP2016/001560 filed Mar. 17, 2016.
Shanghai Silk (4th) p. 2-12 (Dec. 15, 2008).

* cited by examiner

*Primary Examiner* — Alicia J Sawdon
(74) *Attorney, Agent, or Firm* — Oblon, McClelland, Maier & Neustadt, L.L.P.

(57) ABSTRACT

Disclosed is a napped artificial leather dyed with a cationic dye, including: a non-woven fabric of a cationic dyeable polyester fiber having a fineness of 0.07 to 0.9 dtex; and an elastic polymer provided inside the non-woven fabric, wherein the napped artificial leather has L* value≤50, a grade of color difference determined in an evaluation of color migration to PVC under a load 0.75 kg/cm at 50° C. for 16 hours, of 4 or more, a tear strength per mm of thickness of 30 N or more, and a peel strength of 3 kg/cm or more.

15 Claims, No Drawings

NAPPED ARTIFICIAL LEATHER DYED WITH CATIONIC DYE, AND METHOD FOR MANUFACTURING THE SAME

TECHNICAL FIELD

The present invention relates to a napped artificial leather dyed with a cationic dye.

BACKGROUND ART

Napped artificial leathers having dense nap, such as a suede-like artificial leather and a nubuck-like artificial leather, have been known so far. Napped artificial leathers are used as surface materials for clothing, shoes, article of furniture, car seats, general merchandise and the like, and a surface material for casings of mobile phones, mobile devices, home electrical appliances and the like. Such napped artificial leathers are usually dyed.

A napped artificial leather is obtained by napping the surface of an artificial leather base material obtained by containing an elastic polymer such as a polyurethane inside a non-woven fabric of ultrafine fibers. As the non-woven fabric of ultrafine fibers, a napped artificial leather that uses a polyester ultrafine fibers-entangled body is preferably used due to its well-balanced mechanical properties and texture.

In order to dye the napped artificial leather including a non-woven fabric of polyester ultrafine fibers, a disperse dye have been widely used because of their excellent color development so far. However, a disperse dye have a problem that they tend to cause color migration to other articles coming into contact therewith, under heat or pressure.

In order to solve such a problem, dyeing using a cationic dye has been attempted. For example, PTL 1 below discloses a cationic dye-dyeable leather-like sheet composed of a polyurethane and a fiber structure, the polyurethane being obtained by reacting an OH-terminated intermediate diol (D); a low-molecular weight diol (E); and diphenyl methane-4,4'-diisocyanate (C2), the OH-terminated intermediate diol (D being obtained by reacting: a sulfonic acid group-containing diol (A) obtained by substantially replacing an acid component of sulfoisophthalic acid with a specific diol; a polymer diol (B) having a number-average molecular weight of 500 to 3000 and selected from the group consisting of a polyester, a polycarbonate, a polylactone, and a polyether; and an organic diisocyanate (C1) in a quantitative relationship that the equivalence ratio of NCO/OH is 0.5 to 0.99.

In addition, for example, PTL 2 below, which is directed to a technique relating to a synthetic leather, discloses a synthetic leather obtained by forming a resin layer on a surface of a double Russell fabric, wherein the double Russell fabric is composed of a frontside knitted fabric, a backside knitted fabric, and a pile layer interlocking the frontside knitted fabric and the backside knitted fabric, fibers constituting the frontside knitted fabric are polyester fibers dyed using a cationic dye, and the resin layer is formed on the frontside knitted fabric side. The polyester fibers are constituted by a polyester composed of a dicarboxylic acid component composed mainly of terephthalic acid and a glycol component composed mainly of ethylene glycol, and contains, as the dicarboxylic acid component, a component represented by the following formula (III):

[Chem. 1]

(III)

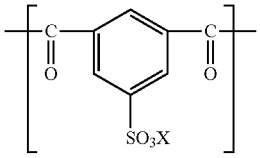

[in the formula (III), X represents a metal ion, a quaternary phosphonium ion, or a quaternary ammonium ion].

Further, for example, PTL 3 below discloses a deodorizing fabric dyed using a cationic dye, the deodorizing fabric having been subjected to a deodorizing treatment, wherein the deodorizing fabric contains, as a copolymer component, a copolymer polyester fiber "a" containing, in the acid component, a sulfoisophthalic acid metal salt (A) and a sulfoisophthalic acid quaternary phosphonium salt or quaternary ammonium salt (B) such that $3.0 \leq A+B \leq 5.0$ (mol %) and $0.2 \leq B/(A+B) \leq 0.7$ are satisfied.

CITATION LIST

Patent Literatures

[PTL 1] Japanese Laid-Open Patent Publication No. H6-192968

[PTL 2] Japanese Laid-Open Patent Publication No. 2014-29050

[PTL 3] Japanese Laid-Open Patent Publication No. 2010-242240

SUMMARY OF INVENTION

Technical Problem

Cationic dyeable polyester fibers have a low fiber intensity, because of existence of copolymer units serving as dye sites for dyeing the cationic dye. Therefore, in the case of manufacturing a napped artificial leather containing such fibers, there is the problem that the ultrafine fibers tend to be detached when the surface is rubbed. Further, a napped artificial leather including a non-woven fabric of polyester ultrafine fibers that have been dyed into a relatively deep color with a cationic dye has a problem that it tends to cause color migration to another article coming into contact therewith.

It is an object of the present invention to provide a napped artificial leather that suppresses the detachment of napped ultrafine fibers in a napped artificial leather dyed with a cationic dye, and is less likely to cause color migration to another article coming into contact therewith, and a method for stably manufacturing the same.

Solution to Problem

An aspect of the present invention is directed to a napped artificial leather dyed with a cationic dye, including: a non-woven fabric of a cationic dyeable polyester fiber having a fineness of 0.07 to 0.9 dtex; and an elastic polymer provided inside the non-woven fabric, wherein the napped artificial leather has L* value≤50, a grade of color difference determined in an evaluation of color migration to PVC under a load 0.75 kg/cm at 50° C. for 16 hours, of 4 or more, a tear strength per mm of thickness of 30 N or more, and a peel strength of 3 kg/cm or more.

Another aspect of the present invention is directed to a method for manufacturing a napped artificial leather dyed with a cationic dye, including the steps of: preparing an artificial leather base material including a non-woven fabric of ultrafine fibers of 0.07 to 0.9 dtex of a cationic dyeable polyester and an elastic polymer impregnated into the non-woven fabric; dyeing the artificial leather base material using a cationic dye, and thereafter washing the artificial leather base material in a hot water bath at 50 to 100° C. containing an anionic surfactant; and, either before or after the dyeing and washing step, napping at least one surface of the artificial leather base material, wherein the cationic dyeable polyester includes a polyester containing a dicarboxylic acid unit composed mainly of a terephthalic acid unit and a glycol unit composed mainly of an ethylene glycol unit, and contains, as the dicarboxylic acid unit, 1.5 to 3 mol % of a unit represented by the following formula ($I_b$):

[Chem. 2]

(Ib)

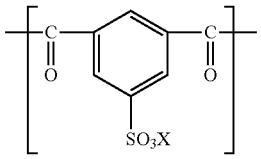

[in the formula ($I_b$), X represents a quaternary phosphonium ion or a quaternary ammonium ion].

ADVANTAGEOUS EFFECTS OF INVENTION

According to the present invention, it is possible to obtain a napped artificial leather dyed with a cationic dye, wherein the napped artificial leather suppresses the detachment of ultrafine fibers and is less likely to cause color migration to another article coming into contact therewith.

DESCRIPTION OF EMBODIMENT

An embodiment of a napped artificial leather dyed with a cationic dye according to the present invention will now be described in detail, in conjunction with an exemplary manufacturing method thereof.

In a method for manufacturing a napped artificial leather according to the present embodiment, an artificial leather base material is first prepared that includes an ultrafine fiber-entangled body including ultrafine fibers of 0.07 to 0.9 dtex of a cationic dyeable polyester and an elastic polymer impregnated into the ultrafine fiber-entangled body.

Specific examples of the method for manufacturing the artificial leather base material include the following method.

First, an entangled body of ultrafine fiber-generating fibers capable of forming dyeable polyester ultrafine fibers of 0.07 to 0.9 dtex is produced.

In the production of the entangled body of the ultrafine fiber-generating fibers, first, a fiber web of the ultrafine fiber-generating fibers is produced. Examples of the production method of the fiber web include a method involving melt-spinning ultrafine fiber-generating fibers and directly collecting the resultant fibers as filaments without intentionally cutting them, and a method involving cutting the resultant fibers into staples and subjecting them to a known entangling treatment. Note that "filaments" are fibers that are not staples, and have not been cut into a predetermined length. The length thereof is, for example, preferably 100 mm or more, more preferably 200 mm or more, from the viewpoint of sufficiently increasing the fiber density. The upper limit for the length of the filaments is not particularly limited, and may be several meters, several hundred meters, several kilometers, or longer, and continuously spun. Among these, it is particularly preferable to produce a filament web in that ultrafine fibers are less likely to be detached because slipping out of the fibers is less likely to occur, and that a napped artificial leather having excellent mechanical properties can be obtained. In the present embodiment, the production of a filament web will be described in detail as a representative example.

Here, "ultrafine fiber-generating fiber" refers to a fiber that forms an ultrafine fiber with a small fineness as a result of being subjected to a chemical or physical post-treatment after being spun. Specific examples thereof include an island-in-the-sea composite fiber in which a polymer of an island component serving as a domain different from a sea component is dispersed in a polymer of the sea component serving as a matrix on the fiber cross section, and the sea component is later removed to form a fiber bundle-like ultrafine fiber composed mainly of the island component polymer; and a strip/division-type composite fiber in which a plurality of different resin components are alternately disposed around the periphery of a fiber to form a petaline shape or a superposed shape, and the fiber is divided as a result of the resin components being stripped from the fiber by a physical treatment, thereby forming a bundle-like ultrafine fiber. The use of the island-in-the-sea composite fiber can suppress damage to the fibers such as cracking, bending, and breaking during an entangling treatment such as needle punching, which will be described below. In the present embodiment, the formation of ultrafine fibers by using the island-in-the-sea composite fiber will be described in detail as a representative example.

The island-in-the-sea composite fiber is a multicomponent composite fiber composed of at least two polymers, and has a cross section on which an island component polymer is dispersed in a matrix composed of a sea component polymer. A filament web of the island-in-the-sea composite fiber is formed by melt-spinning the island-in-the-sea composite fiber and directly collecting the resultant fiber as a filament on a net without cutting it.

In the present embodiment, it is preferable to use, as the island component polymer, a dyeable polyester obtained by copolymerizing a dicarboxylic acid component composed mainly of terephthalic acid containing 1.5 to 3 mol % of a component represented by the following formula (II), and a glycol component composed mainly of ethylene glycol.

[Chem. 3]

(II)

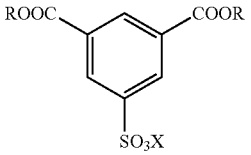

[in the above formula (II), R represents hydrogen, an alkyl group or a 2-hydroxyethyl group having 1 to 10 carbon atoms, and X represents a quaternary phosphonium ion or a quaternary ammonium ion].

Examples of the compound represented by the formula (II) include 5-tetraalkyl phosphonium sulfoisophthalic acids such as 5-tetrabutyl phosphonium sulfoisophthalic acid and 5-ethyl tributyl phosphonium sulfoisophthalic acid; and 5-tetraalkyl ammonium sulfoisophthalic acids such as 5-tetrabutyl ammonium sulfoisophthalic acid, 5-ethyl tributyl ammonium sulfoisophthalic acid. The compounds represented by the formula (II) may be used alone or in a combination of two or more. By copolymerizing a dicarboxylic acid component composed mainly of terephthalic acid and containing a compound represented by the formula (II) preferably in an amount of 1.5 to 3 mol %, with a glycol component composed mainly of ethylene glycol, it is possible to obtain a dyeable polyester having excellent dyeability with a cationic dye, as well as excellent mechanical properties and high-speed spinnability.

The ratio of the unit represented by the formula (I) derived from the formula (II) in the dyeable polyester is preferably 1.5 to 3 mol %, more preferably 1.6 to 2.5 mol %. When the ratio of the unit represented by the formula (I) is less than 1.5 mol %, the color development when the napped artificial leather is dyed using a cationic dye tends to be reduced. On the other hand, when the ratio of the unit represented by the formula (I) exceeds 3 mol %, it becomes difficult to obtain ultrafine fibers because the high-speed spinnability is reduced, and the mechanical properties, such as a tear strength, of the resulting napped artificial leather tend to be significantly reduced.

Here, "composed mainly of terephthalic acid" means that a terephthalic acid component constitutes 50 mol % or more of the dicarboxylic acid component. The content ratio of the terephthalic acid component in the dicarboxylic acid component is preferably 75 mol % or more. In order to achieve enhanced dyeability with a cationic dye, enhanced high-speed spinnability, and enhanced formability in the case of using the napped artificial leather in molding applications, another dicarboxylic acid component, excluding the component represented by the formula (II), may be contained as the dicarboxylic acid component, for the purpose of lowering the glass transition temperature. Specific examples of the other dicarboxylic acid component that may be contained include other dicarboxylic acid components, including, for example, aromatic dicarboxylic acids such as isophthalic acid, cyclohexanedicarboxylic acid components such as 1,4-cyclohexanedicarboxylic acid, and aliphatic dicarboxylic acid components such as adipic acid. Among these, it is particularly preferable to contain isophthalic acid, or a combination of 1,4-cyclohexanedicarboxylic acid and adipic acid, in terms of excellent mechanical properties and high-speed spinnability.

As the dicarboxylic acid component, the copolymerization ratio of the other dicarboxylic acid component is preferably 2 to 12 mol %, more preferably 3 to 10 mol %. When the copolymerization ratio of the other dicarboxylic acid component is less than 2 mol %, the glass transition temperature is not sufficiently lowered, so that the dyeability tends to be reduced because of an increased degree of orientation of the amorphous sites inside the fibers. On the other hand, when the copolymerization ratio of the other dicarboxylic acid component exceeds 12 mol %, the glass transition temperature is excessively lowered, so that the fiber strength tends to be reduced because of a decreased degree of orientation of the amorphous sites inside the fibers. Note that when isophthalic acid is contained as the other dicarboxylic acid unit, preferably 1 to 6 mol %, more preferably 2 to 5 mol % of isophthalic acid is contained as the dicarboxylic acid unit, in terms of excellent mechanical properties and high-speed spinnability. When 1,4-cyclohexanedicarboxylic acid and adipic acid are contained, preferably 1 to 6 mol %, more preferably 2 to 5 mol % of each of 1,4-cyclohexanedicarboxylic acid and adipic acid is contained, in terms of excellent mechanical properties and high-speed spinnability.

Note that an alkali metal salt unit such as a sulfoisophthalic acid sodium salt may be contained as the other dicarboxylic acid component. However, when the ratio of the sulfoisophthalic acid alkali metal salt unit is too high, the high-speed spinnability is reduced, and the mechanical properties, such as a tear strength, of the resulting artificial leather base material tend to be significantly reduced. Therefore, when an alkali metal salt unit such as a sulfoisophthalic acid sodium salt is contained, it is preferable that 0 to 0.2 mol % of the alkali metal salt unit is contained as the dicarboxylic acid unit, and it is more preferable that no alkali metal salt unit is contained.

Further, "composed mainly of ethylene glycol" means that an ethylene glycol component constitutes 50 mol % or more of the glycol component. The ethylene glycol component content in the glycol component is preferably 75 mol % or more, more preferably 90 mol % or more. In addition, examples of the other component include diethylene glycol and polyethylene glycol.

The glass transition temperature (Tg) of the dyeable polyester is not particularly limited, but is preferably 60 to 70° C., more preferably 60 to 65° C. When Tg is too high, the high-speed drawability is reduced, and the formability tend to be reduced in the case of heat-molding the resulting napped artificial leather for use.

A colorant such as carbon black, a weatherproofing agent, an antifungal agent, and the like may be blended in the dyeable polyester as needed, so long as the effects of the present invention will not be impaired.

The melt viscosity of the dyeable polyester at 270° C. and a shear rate of 1220 (1/s) is preferably 80 to 220 Pa·s, in view of that the high-speed spinnability and the physical properties of the resulting napped artificial leather, as well as the formability in the case of heat-molding the napped artificial leather for use are excellent.

As the sea component polymer, a polymer having higher solubility in a solvent or higher decomposability by a decomposition agent than those of the dyeable polyester is selected. Also, a polymer having low affinity for the dyeable polyester and a smaller melt viscosity and/or surface tension than those of the island component polymer under the spinning condition is preferable in terms of the excellent spinning stability of the island-in-the-sea composite fiber. Specific examples of the sea component polymer satisfying such conditions include a water-soluble polyvinyl alcohol resin (water-soluble PVA), polyethylene, polypropylene, polystyrene, an ethylene-propylene copolymer, an ethylene-vinyl acetate copolymer, a styrene-ethylene copolymer, and a styrene-acrylic copolymer. Among these, the water-soluble PVA is preferable in that it can be removed by dissolution by using an aqueous solvent without using an organic solvent and thus has a low environmental load.

The island-in-the-sea composite fiber can be produced by melt spinning in which the sea component polymer and the dyeable polyester serving as the island component polymer are melt-extruded from a multicomponent fiber spinning spinneret. The temperature of the multicomponent fiber spinning spinneret is not particularly limited so long as it is a temperature at which melt spinning can be performed and is higher than the melting point of each of the polymers constituting the island-in-the-sea composite fiber, but is usually selected from the range of 180 to 350° C.

The fineness of the island-in-the-sea composite fiber is not particularly limited, but is preferably 0.5 to 10 dtex, more preferably 0.7 to 5 dtex. An average area ratio between the sea component polymer and the island component polymer on the cross section of the island-in-the-sea composite fiber is preferably 5/95 to 70/30, more preferably 10/90 to 50/50. The number of domains of the island component on the cross section of the island-in-the-sea composite fiber is not particularly limited, but is preferably 5 to 1000, more preferably 10 to 300, in terms of the industrial productivity.

The molten island-in-the-sea composite fiber discharged from the spinneret is cooled by a cooling apparatus, and is further drawn out and attenuated by using a suction apparatus such as an air jet nozzle so as to have a desired fineness. Specifically, the island-in-the-sea composite fiber is drawn out and attenuated with a high-velocity air stream that provides a high spinning speed corresponding to a take-up speed of preferably 1000 to 6000 m/min, more preferably 2000 to 5000 m/min. Then, the drawn and attenuated filaments are piled on a collection surface of a movable net or the like, thereby obtaining a filament web. Note that, in order to stabilize the shape, a part of the filament web may be further pressure-bonded by pressing the filament web if necessary. The basis weight of the filament web thus obtained is not particularly limited, but is preferably in the range of 10 to 1000 g/m$^2$.

Then, the obtained filament web is subjected to an entangling treatment, thereby producing an entangled web.

Specific examples of the entangling treatment for the filament web include a treatment in which a plurality of layers of filament webs are superposed in the thickness direction by using a cross lapper or the like, and subsequently needle-punched simultaneously or alternately from both sides such that at least one barb penetrates the web.

In addition, an oil solution, an antistatic agent, or the like may be added to the filament web in any stage from the spinning step to the entangling treatment of the island-in-the-sea composite fiber. Furthermore, if necessary, the entangled state of the filament web may be densified in advance by performing a shrinking treatment in which the filament web is immersed in warm water at 70 to 150° C. The fiber density may be increased by performing hot pressing after needle punching so as to provide shape stability. The basis weight of the entangled web thus obtained is preferably in the range of 100 to 2000 g/m$^2$.

If necessary, the entangled web may be subjected to a treatment in which the entangled web is heat-shrunk such that the fiber density and the degree of entanglement thereof are increased. Specific examples of the heat shrinking treatment include a method involving bringing the entangled web into contact with water vapor, and a method involving applying water to the entangled web, and subsequently heating the water applied to the entangled web by using hot air or electromagnetic waves such as infrared rays. For the purpose of, for example, further densifying the entangled web that has been densified by the heat-shrinking treatment, fixing the shape of the entangled web, and smoothing the surface thereof, the fiber density may be further increased by performing hot pressing as needed.

The change in the basis weight of the entangled web during the heat-shrinking treatment step is preferably 1.1 times (mass ratio) or more, more preferably 1.3 times or more and 2 times or less, further preferably 1.6 times or less, as compared with the basis weight before the shrinking treatment. Note that the entangled state affects the mechanical properties of the resulting napped artificial leather. In the present embodiment, it is preferable that the filament web is densely entangled such that the napped artificial leather after being dyed with a cationic dye, has a tear strength per mm of thickness of 30 N or more and a peel strength of 3 kg/cm or more.

Then, the sea component polymer is removed from the island-in-the-sea composite fiber in the entangled web that has been densified, thereby obtaining an ultrafine filament non-woven fabric that is an entangled body of fiber bundle-like ultrafine filaments of the dyeable polyester. As the method for removing the sea component polymer from the island-in-the-sea composite fiber, a conventionally known ultrafine fiber formation method such as a method involving treating the entangled web with a solvent or decomposition agent capable of selectively removing only the sea component polymer can be used without any particular limitation. Specifically, in the case of using, for example, a water-soluble PVA as the sea component polymer, it is possible to use hot water as the solvent. In the case of using a modified polyester that is easily decomposed by alkali as the sea component polymer, it is possible to use an alkaline decomposition agent such as an aqueous sodium hydroxide solution.

In the case of using the water-soluble PVA as the sea component polymer, it is preferable to remove the water-soluble PVA by extraction until the removal rate of the water-soluble PVA becomes 95 to 100 mass % by treating the web in hot water at 85 to 100° C. for 100 to 600 seconds. Note that the water-soluble PVA can be efficiently removed by extraction by repeating a dip-nipping treatment. The use of the water-soluble PVA is preferable in terms of a low environmental load and reduced generation of VOCs since the sea component polymer can be selectively removed without using an organic solvent.

The fineness of the ultrafine fiber formed in this manner is 0.07 to 0.9 dtex, preferably 0.07 to 0.3 dtex.

The basis weight of the ultrafine filament non-woven fabric thus obtained is preferably 140 to 3000 g/m$^2$, more preferably 200 to 2000 g/m$^2$. The apparent density of the ultrafine filament non-woven fabric is preferably 0.45 g/cm$^3$ or more, more preferably 0.55 g/cm$^3$ or more in that a dense non-woven fabric can be formed, thus obtaining a non-woven fabric exhibiting an excellent mechanical strength and having fullness. Although the upper limit is not particularly limited, the apparent density is preferably 0.70 g/cm$^3$ or less in that a pliable texture can be obtained and excellent productivity can also be achieved.

In the manufacture of a napped artificial leather according to the present embodiment, an elastic polymer such as a polyurethane elastomer is impregnated into the internal voids of the non-woven fabric either before or after or both before and after generating an ultrafine fiber from an ultrafine fiber-generating fiber such as an island-in-the-sea composite fiber in order to impart shape stability and fullness to the non-woven fabric.

Specific examples of the elastic polymer include polyurethanes, acrylonitrile elastomers, olefin elastomers, polyester elastomers, polyamide elastomers, and acrylic elastomers. Among these, polyurethanes, in particular, an aqueous polyurethane is preferable.

An aqueous polyurethane refers to a polyurethane that is solidified from a polyurethane emulsion, or a polyurethane dispersion dispersed in an aqueous solvent. The aqueous polyurethane usually has insolubility in an organic solvent, and forms a cross-linked structure after being solidified. When the polyurethane emulsion has thermal gelation properties, the emulsion particles are thermally gelled without migration, thus making it possible to evenly apply the elastic polymer to the fiber-entangled body.

Examples of the method for impregnating the elastic polymer into the non-woven fabric include a dry method in which an emulsion, dispersion, solution, or the like containing the polyurethane elastomer is impregnated into an entangled web before generating an ultrafine fiber or a non-woven fabric after generating an ultrafine fiber, followed by drying and solidification, and a method in which the solidification is performed by a wet method or the like. Here, in the case of using an elastic polymer, such as an aqueous polyurethane, that forms a cross-linked structure after being solidified, a curing treatment in which the polymer is heat-treated after being solidified and dried may be performed in order to promote crosslinking, if necessary.

Examples of the method for impregnating the emulsion, dispersion, solution or the like of the elastic polymer include dip-nipping in which a treatment of nipping by a press roll or the like to achieve a predetermined impregnated state is performed once or a plurality of times, bar coating, knife coating, roll coating, comma coating, and spray coating.

Note that the elastic polymer may further contain a colorant such as a dye or a pigment (e.g., carbon black), a coagulation regulator, an antioxidant, an ultraviolet absorber, a fluorescent agent, an antifungal agent, a penetrant, an antifoaming agent, a lubricant, a water-repellent agent, an oil-repellent agent, a thickener, a filler, a curing accelerator, a foaming agent, a water-soluble polymer compound such as polyvinyl alcohol or carboxymethyl cellulose, inorganic fine particles, and a conductive agent, so long as the effects of the present invention will not be impaired.

The content ratio of the elastic polymer is preferably 0.1 to 50 mass %, more preferably 0.1 to 40 mass %, particularly preferably 5 to 25 mass %, even more preferably 10 to 15 mass %, relative to the total amount of the elastic polymer and the ultrafine fibers, in terms of the good balance between the fullness and the pliability or the like of the resulting napped artificial leather. An excessively high content ratio of the elastic polymer tends to give rise to color migration from the dyed napped artificial leather to another object coming into contact therewith.

In this manner, an artificial leather base material that is a non-woven fabric of ultrafine fibers of 0.07 to 0.9 dtex that has been impregnated with the elastic polymer is obtained. The thus obtained artificial leather base material is sliced into a plurality of pieces or ground in a direction perpendicular to the thickness direction so as to regulate the thickness thereof, if necessary. Then, the artificial leather base material is further napped by being buffed on at least one surface by using sand paper or emery paper having a grit number of preferably 120 to 600, more preferably 320 to 600. In this manner, a napped artificial leather on which a napped surface obtained by napping one or both surfaces of the artificial leather base material is formed is obtained.

The thickness of the napped artificial leather is not particularly limited, but is preferably 0.2 to 4 mm, more preferably 0.5 to 2.5 mm.

The length of the napped fibers of the napped artificial leather is not particularly limited, but is preferably 1 to 500 μm, more preferably 30 to 200 μm, from the viewpoint of providing a napped artificial leather having fine short fibers resembling those of a natural nubuck leather.

The napped artificial leather according to the present embodiment is dyed with a cationic dye. When dyeing is carried out using a cationic dye, the cationic dye is fixed by ionic bonding to sulfonium ions contained in the unit that serves as a dye site of the dyeable polyester for the cationic dye and is represented by the following formula ($I_a$):

[Chem. 4]

(Ia)

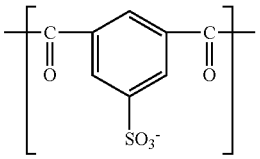

Accordingly, excellent dye fastness can be achieved. As such a cationic dye, any cationic dye that has hitherto been known may be used without particular limitations. Note that the cationic dye is dissolved in a dye liquid to form dye ions having cationic properties, for example, a dye ion having a quaternary ammonium group or the like, and is ionically bonded to the fibers. In general, such a cationic dye forms a salt with anions such as chlorine ions. Such anions such as chlorine ions are contained in the cationic dye, but are washed off by washing performed after dyeing.

The dyeing method includes, but is not particularly limited to, methods using dyeing machines such as a jet dyeing machine, a beam dyeing machine, or a jigger. As the conditions for the dyeing treatment, dyeing may be performed at a high pressure. However, the polyester ultrafine fibers according to the present embodiment is dyeable at normal pressure, and thus are preferably dyed at normal pressure in terms of a low environmental load and a reduced dyeing cost as well. In the case of performing dyeing at normal pressure, the dyeing temperature is preferably 60 to 100° C., more preferably 80 to 100° C. During dyeing, a dyeing auxiliary such as acetic acid or sodium sulfate may be used.

In the present embodiment, the napped artificial leather dyed using a cationic dye is subjected to a washing treatment in a hot water bath containing an anionic surfactant, thereby removing the cationic dye, which has a low bonding strength. In particular, the cationic dye absorbed by the elastic polymer is sufficiently removed by such a washing treatment, thus making it possible to sufficiently inhibit color migration of the resulting dyed napped artificial leather. Specific examples of the anionic surfactant include Sordine R manufactured by NISSEI KASEI CO., LTD., SENKANOL A-900 manufactured by SENKA corporation, and Meisanol KHM manufactured by Meisei Chemical Works Ltd.

The washing treatment in a hot water bath containing the anionic surfactant is performed in a hot water bath at preferably 50 to 100° C., more preferably 60 to 80° C. As the bath for the hot water bath, it is preferable to use the dyeing machine with which the dyeing treatment has been performed, in terms of simplification of the manufacturing process.

The washing time is preferably such that the cotton stain in a water fastness test according to a JIS method (JIS L 0846) is determined to be a grade of 4-5 or more. Specifically, the time is preferably 10 to 30 minutes, more preferably 15 to 20 minutes. This washing may be repeated more than once. The napped artificial leather that has been dyed and washed in this manner is dried. Note that the color migration of the cationic dye can be sufficiently suppressed by sufficiently washing the washable chlorine contained in the cationic dye by the above-described washing method or the like such that the chlorine content is 90 ppm or less relative to the weight of the dyed napped artificial leather.

The napped artificial leather is subjected to various finishing treatments as needed. Examples of the finishing treatments include a softening treatment by rubbing, a reverse seal brushing treatment, an antifouling treatment, a hydrophilization treatment, a lubricant treatment, a softener treatment, an antioxidant treatment, an ultraviolet absorber treatment, a fluorescent agent treatment, and a flame retardant treatment.

In this manner, a napped artificial leather dyed with a cationic dye according to the present embodiment is obtained. The dyed napped artificial leather according to the present embodiment is less likely to cause color migration to another object even when it has a deep color such as L* value≤50.

When the napped artificial leather dyed with a cationic dye includes ultrafine fibers derived from ultrafine fibers including a polyester containing a dicarboxylic acid unit composed mainly of a terephthalic acid unit containing 1.5 to 3 mol % of a unit represented by the formula ($I_a$) and including a quaternary phosphonium group or a quaternary ammonium group, and a glycol unit composed mainly of an ethylene glycol unit, it is possible to contain ultrafine fibers as continuous long fibers having a high mechanical strength, which are produced without reducing the high-speed spinnability of the ultrafine fiber-generating fiber. Further, after being dyed using a cationic dye, the artificial leather base material is subjected to a washing treatment in a hot water bath containing an anionic surfactant, and thereby, the cationic dye is sufficiently washed off from the elastic polymer, thus sufficiently suppressing the color migration or the like that could be caused by the cationic dye remaining in the elastic polymer.

Specifically, it is preferable that the napped artificial leather dyed with a cationic dye according to the present embodiment includes a non-woven fabric of cationic dyeable polyester fibers having a fineness of 0.07 to 0.9 dtex and an elastic polymer provided inside the non-woven fabric, and is adjusted so as to have L* value≤50 and a grade of color difference determined in an evaluation of color migration to PVC under a load of 0.75 kg/cm at 50° C. for 16 hours, of 4 or more. By adjusting the napped artificial leather so as to have such characteristics, it is possible to obtain a napped artificial leather that is less likely to cause the detachment of the napped ultrafine fibers, and is less likely to cause color migration to another article coming into contact therewith, even when the napped artificial leather is dyed using a cationic dye into a relatively deep color.

The napped artificial leather dyed with a cationic dye according to the present embodiment has a relatively deep color tone so as to have preferably L* value≤50, more preferably L* value≤35. Note that L* value≤35 can be easily achieved, while suppressing color migration, not only by dyeing, but also by containing a pigment such as carbon black in the cationic dyeable polyester fibers or the elastic polymer. Such a napped artificial leather can suppress color migration by using the cationic dyeable polyester fiber described above and performing a washing treatment in a hot water bath containing an anionic surfactant, even when it has a deep color. Specifically, a dyed napped artificial leather having a grade of color difference of 4 or more in determined in an evaluation of color migration to PVC a under a load of 0.75 kg/cm at 50° C. for 16 hours can be obtained.

The napped artificial leather dyed with a cationic dye according to the present embodiment is adjusted to have a high mechanical strength such as a tear strength per mm of thickness of 30 N or more and a peel strength of 3 kg/cm or more, thereby suppressing detachment of ultrafine fibers.

It is preferable that the napped artificial leather dyed with a cationic dye has a tear strength per mm of thickness of 30 N or more, preferably 35 N or more, more preferably 40 N or more, and a peel strength of 3 kg/cm or more, preferably 3.5 kg/cm or more, particularly preferably 4 kg/cm or more, since the napped ultrafine fibers are less likely to be detached.

Note that the likelihood of occurrence of fuzzing of the napped artificial leather can be evaluated, for example, on the basis of a Martindale abrasion loss. With the napped artificial leather dyed with a cationic dye, it is possible to obtain a napped artificial leather dyed with a cationic dye in which the ultrafine fibers are less likely to be detached when the surface is rubbed, so as to have a Martindale abrasion loss of preferably 100 mg or less after 35000 times of rubbing, more preferably 95 mg or less after 35000 times of rubbing.

EXAMPLES

Hereinafter, the present invention will be described more specifically by way of examples. It should be appreciated that the scope of the present invention is by no means limited by the examples.

Example 1

Ethylene-modified polyvinyl alcohol (ethylene unit content: 8.5 mol %, a degree of polymerization: 380, a saponification degree: 98.7 mol %) as a thermoplastic resin serving as a sea component, and a polyethylene terephthalate (PET) (containing 1.7 mol % of a sulfoisophthalic acid tetrabutyl phosphonium salt unit, 5 mol % of a 1,4-cyclohexanedicarboxylic acid unit, and 5 mol % of an adipic acid unit and having a glass transition temperature of 62° C.) modified with a sulfoisophthalic acid tetrabutyl phosphonium salt as a thermoplastic resin serving as an island component were molten separately. Then, each of the molten resins was supplied to a multicomponent fiber spinning spinneret having many nozzle holes disposed in parallel, such that a cross section on which 25 island component portions having uniform cross-sectional areas were distributed in the sea component can be formed. At this time, the molten resins were supplied while adjusting the pressure such that the mass ratio between the sea component and the island component satisfies Sea component/Island component=25/75. Then, the molten resins were discharged from the nozzle holes set at a spinneret temperature of 260° C.

Then, the molten fibers discharged from the nozzle holes were drawn by suction by using an air jet nozzle suction apparatus with an air stream pressure regulated so as to provide an average spinning speed of 3700 m/min, thus spinning the island-in-the-sea composite filaments with a fineness of 2.1 dtex at a high speed. The spun island-in-the-sea composite filaments were continuously piled on a movable net while being suctioned from the back side of the net. The piled amount was regulated by regulating the movement speed of the net. Then, in order to suppress the fuzzing on the surface, the island-in-the-sea composite filaments piled on the net were softly pressed with a metal roll at 42° C. Then, the island-in-the-sea composite filaments were removed from the net, and allowed to pass between a grid-patterned metal roll having a surface temperature of 75° C. and a back roll, thereby hot pressing the fibers with a linear load of 200 N/mm. In this manner, a filament web having a basis weight of 34 g/m$^2$ and in which the fibers on the surface were temporarily fused in a grid pattern was obtained.

Next, an oil solution mixed with an antistatic agent was sprayed to the surface of the obtained filament web, and thereafter, 10 sheets of the filament web were stacked by using a cross lapper apparatus to form a superposed web with a total basis weight of 340 g/m$^2$, and an oil solution for preventing the needle from breaking was further sprayed thereto. Then, the superposed web was needle-punched, thereby performing a three-dimensional entangling treatment. Specifically, the stack was needle-punched at a density of 3300 punch/cm$^2$ alternately from both sides by using 6-barb needles with a distance of 3.2 mm from the needle tip to the first barb at a punching depth of 8.3 mm. The area shrinkage by the needle punching was 18%, and the basis weight of the entangled web after the needle punching was 415 g/m$^2$.

The obtained entangled web was densified by being subjected to a heat-moisture shrinking treatment in the following manner. Specifically, water at 18° C. was uniformly sprayed in an amount of 10 mass % to the entangled web, and the entangled web was heat-treated by being stood still in an atmosphere with a temperature of 70° C. and a relative humidity of 95% for 3 minutes with no tension applied, thereby heat-moist shrinking the entangled web so as to increase the apparent fiber density. The area shrinkage by the heat-moisture shrinking treatment was 45%, and the densified entangled web had a basis weight of 750 g/m$^2$ and an apparent density of 0.52 g/cm$^3$. Then, for further densification, the entangled web was pressed with a dry-heat roll, thereby adjusting the apparent density to 0.60 g/cm$^3$.

Next, an emulsion of an aqueous polyurethane capable of forming a cross-linked structure after being solidified (emulsion having a polyurethane solid content concentration of 30% and composed mainly of polycarbonate/ether polyurethane) was impregnated into the densified entangled web as a polyurethane elastomer. Then, the entangled web was dried in a drying furnace at 150° C.

Next, the entangled web in which the aqueous polyurethane has been applied was immersed in hot water at 95° C. for 20 minutes to remove the sea component contained in the island-in-the-sea composite filaments by extraction, and then was dried in a drying furnace at 120° C., thereby obtaining an artificial leather base material containing a non-woven fabric of ultrafine filaments having a fineness of 0.1 dtex and into which the aqueous polyurethane was impregnated. The mass ratio of the non-woven fabric to the aqueous polyurethane of the obtained artificial leather base material was 90/10. Then, the obtained artificial leather base material was sliced into halves in the thickness direction, and the surface thereof was napped by being buffed with sand paper with a grit number of 600.

Then, the napped artificial leather was dyed into a red color by being immersed for 40 minutes in a dyeing bath at 90° C. containing 8% owf of a cationic dye "Nichilon Red-GL" (manufactured by NISSEI KASEI CO., LTD.; containing 4% of washable chlorine in the dye) as a dye and 1 g/L of 90% acetic acid as a dyeing auxiliary at a liquor ratio of 1:30. Then, a step of washing the napped artificial leather using a hot water bath containing 2 g/L of Soluzine R as an anionic surfactant at 70° C. for 20 minutes was repeated twice in the same dyeing bath. Then, after washing, the napped artificial leather was dried to give a dyed napped artificial leather.

In this manner, a dyed napped artificial leather including a non-woven fabric of ultrafine filaments with a fineness of 0.1 dtex and having a napped surface on one surface was obtained. The obtained napped artificial leather had a thickness of 0.6 mm and a basis weight of 350 g/m$^2$. The length of the napped fibers was about 80 μm.

Then, the napped artificial leather was evaluated for the spinning stability, the color development, the color migration, and the tear strength of the island-in-the-sea composite filaments in the following manner.

[Spinning Stability]

The stability during suction and drawing using an air jet nozzle suction apparatus with an air stream pressure regulated so as to provide an average spinning speed of 3700 m/min as described above was evaluated according to the following criteria.

A: There was no fiber breakage.

B: Many defects resulting from fiber breakage were contained, or fiber breakage made spinning impossible.

[Color Development]

Using a spectrophotometer (CM-3700 manufactured by KONICA MINOLTA HOLDINGS, INC.), the lightness L* was determined on the basis of coordinate values of the L*a*b* color system of the surface of the cut-out dyed napped artificial leather in accordance with JIS Z 8729. This value was an average of three values measured at average positions evenly selected from the test strip.

[Color Migration]

A 0.8 mm-thick vinyl chloride film (white) was placed on the surface of the cut-out napped artificial leather, and a pressure was uniformly applied thereto so as to provide a load of 750 g/cm$^2$. Then, the napped artificial leather was left under an atmosphere of 50° C. and a relative humidity of 15% for 16 hours. Then, the color difference ΔE* between the vinyl chloride film before undergoing color migration and the vinyl chloride film after undergoing color migration was measured using a spectrophotometer, and evaluated according to the following criteria.

Grade 5: $0.0 \leq \Delta E^* \leq 0.2$

Grade 4-5: $0.2 < \Delta E^* \leq 1.4$

Grade 4: $1.4 < \Delta E^* \leq 2.0$

Grade 3-4: $2.0 < \Delta E^* \leq 3.0$

Grade 3: $3.0 < \Delta E^* < 3.8$

Grade 2-3: $3.8 < \Delta E^* \leq 5.8$

Grade 2: $5.8 < \Delta E^* \leq 7.8$

Grade 1-2: $7.8 < \Delta E^* \leq 11.4$

Grade 1: $11.4 < \Delta E^*$

[Tear Strength]

A test strip of 10 cm long by 4 cm wide was cut out from the obtained dyed napped artificial leather. Then, a 5 cm-long cut was made at the center of the shorter side of the test strip, parallel to the longer side. Then, using a tensile testing machine, the split ends of the test strip were nipped by chucks of the jig, and an s-s curve was measured at a tensile speed of 10 cm/min. A value obtained by dividing the maximum load by a predetermined basis weight of the test strip was used as a tear strength per mm of thickness. This value is an average value of three test strips.

[Peel Strength]

Two test strips of 15 cm long by 2.5 cm wide were cut out from the obtained dyed napped artificial leather. Then, the two test strips were superposed with each other with a 100-μm polyurethane film (NASA-600, 10 cm long by 2.5 cm wide) interposed therebetween, to give a superposed body. Note that the polyurethane film is not superposed on a portion 2.5 cm from either end of each test strip. Then, using a plate hot pressing machine, the superposed body was bonded by being pressed for 60 seconds under the conditions of a temperature of 130° C. and a surface pressure of 5 kg/cm$^2$, to form an evaluation sample. Using a tensile testing machine at room temperature, the unbonded 2.5 cm portions of the obtained evaluation sample were held by the upper and lower chucks, respectively, and an s-s curve was measured at a tensile speed of 10 cm/min. Taking a median value of the portion where the s-s curve is substantially constant as an average value, a value obtained by dividing the average value by the sample width 2.5 cm was used as a peel strength. This value is an average value of three test strips.

[Martindale Abrasion Loss]

A Martindale abrasion loss in accordance with JIS L 1096 was measured. Specifically, a circular test strip having a diameter of 38 mm was cut out from the obtained dyed napped artificial leather. Then, the test strip was left in a standard state (20° C.×65% RH) for 24 hours, and a weight $W_1$ (mg) was measured. Then, a standard abrading cloth and the above-described test strip were set on a Martindale abrasion tester, and their surfaces were rubbed each other with a load of 12 KPa applied until the counter reached 35000. Then, a weight $W_2$ (mg) of the test strip after completion of the test was measured, and an abrasion loss W (mg)($W_1$-$W_2$), which was a weight loss of the test strip, was calculated.

[Chlorine Content]

In accordance with the method BS EN 14582: 2007, the chlorine content for the dyed napped artificial leather was measured by quantification.

[Glass Transition Temperature and Melting Point]

The glass transition temperature and the melting point of the polyester were measured using a differential scanning calorimeter (DSC) (TA-3000 manufactured by Mettler-Toledo International Inc.).

The results are shown in Table 1 below.

TABLE 1

| Example No. | Polyester: Fineness (dtex) | Copolymer unit (*1) (mol %) | | Other modifications (*2) (mol %) | | Glass transition temperature (° C.) | Melting point (° C.) | Polyurethane ratio (%) | Dye | Anionic surfactant |
|---|---|---|---|---|---|---|---|---|---|---|
| 1 | 0.1 | A | 1.7 | X + Y | 10 | 62 | 228 | 10 | Cationic | Present |
| 2 | 0.1 | A | 2.5 | X + Y | 10 | 61 | 226 | 10 | Cationic | Present |
| 3 | 0.1 | A | 3 | X + Y | 10 | 61 | 225 | 10 | Cationic | Present |
| 4 | 0.1 | A | 1.7 | Z | 3 | 70 | 241 | 10 | Cationic | Present |
| 5 | 0.1 | A | 1.7 | Z | 6 | 67 | 234 | 10 | Cationic | Present |
| 6 | 0.1 | A | 1.7 | X + Y | 10 | 62 | 228 | 20 | Cationic | Present |
| 7 | 0.1 | A | 1.7 | X + Y | 10 | 62 | 228 | 25 | Cationic | Present |
| 8 | 0.1 | B | 1.7 | X + Y | 10 | 62 | 228 | 10 | Cationic | Present |
| 9 | 0.2 | A | 1.7 | Z | 3 | 70 | 241 | 10 | Cationic | Present |
| 10 | 0.3 | A | 1.7 | Z | 3 | 70 | 241 | 10 | Cationic | Present |
| 11 | 0.1 | A | 1.7 | — | — | 76 | 249 | 10 | Cationic | Present |
| 12 | 0.1 | A | 2.5 | — | — | 75 | 248 | 10 | Cationic | Present |
| Com. Ex. 1 | 0.1 | A | 4 | X + Y | 10 | 59 | 223 | 10 | Cationic | Present |
| Com. Ex. 2 | 0.1 | C | 1.7 | X + Y | 10 | 62 | 228 | 10 | Cationic | Present |
| Com. Ex. 3 | 0.1 | A | 1.7 | X + Y | 10 | 62 | 230 | 10 | Cationic | Absent |
| Com. Ex. 4 | 0.1 | — | — | Z | 6 | 73 | 241 | 10 | Disperse | Present |
| Ref. Ex. 1 | 0.1 | A | 1.7 | X + Y | 10 | 62 | 228 | 10 | Cationic | Present |

| Example No. | Chlorine content [ppm] | Peel strength (Kg/cm) | Tear strength (N/mm) | Evaluation results: Spinning Stability | Color development (L* value) | Color migration (grade) (ΔE*) | | Abrasion loss (mg) |
|---|---|---|---|---|---|---|---|---|
| 1 | 59 | 3.8 | 45 | A | 45 | 4-5 | 1.0 | 95 |
| 2 | 53 | 3.5 | 39 | A | 45 | 4-5 | 1.0 | 95 |
| 3 | 51 | 3.2 | 34 | A | 45 | 4-5 | 0.8 | 98 |
| 4 | 65 | 4.0 | 55 | A | 45 | 4-5 | 0.8 | 83 |
| 5 | 67 | 3.9 | 49 | A | 45 | 4-5 | 1.0 | 85 |
| 6 | 70 | 4.0 | 45 | A | 45 | 4 | 1.5 | 80 |
| 7 | 77 | 4.2 | 43 | A | 45 | 4 | 1.8 | 76 |
| 8 | 59 | 3.8 | 43 | A | 45 | 4-5 | 1.0 | 93 |
| 9 | 75 | 4.5 | 55 | A | 40 | 4-5 | 0.8 | 58 |
| 10 | 75 | 4.2 | 53 | A | 38 | 4-5 | 0.4 | 62 |
| 11 | 71 | 4.8 | 58 | B | 45 | 4-5 | 0.7 | 55 |
| 12 | 68 | 3.9 | 49 | B | 45 | 4-5 | 0.5 | 98 |
| Com. Ex. 1 | 58 | 2.5 | 29 | A | 45 | 4-5 | 0.7 | 120 |
| Com. Ex. 2 | 78 | 2.3 | 24 | B | 45 | 4-5 | 1.0 | 189 |
| Com. Ex. 3 | 153 | 3.8 | 45 | A | 45 | 2-3 | 4.2 | 95 |
| Com. Ex. 4 | — | 5.9 | 61 | A | 46 | 2 | 6.0 | 52 |
| Ref. Ex. 1 | 63 | 2.5 | 57 | A | 45 | 4-5 | 1.0 | 108 |

*1 A: Sulfoisophthalic acid tetrabutyl phosphonium salt
B: Sulfoisophthalic acid tetrabutyl ammonium salt
C: Sulfoisophthalic acid sodium salt
*2 X: Cyclohexanedicarboxylic acid
Y: Adipic acid
Z: Isophthalic acid Example 2

A dyed napped artificial leather was obtained in the same manner as in Example 1 except that a PET (containing 2.5 mol % of a sulfoisophthalic acid tetrabutyl phosphonium salt unit, 5 mol % of a 1,4-cyclohexanedicarboxylic acid unit, and 5 mol % of an adipic acid unit) modified with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Example 3

A dyed napped artificial leather was obtained in the same manner as in Example 1 except that a PET (containing 3 mol % of a sulfoisophthalic acid tetrabutyl phosphonium salt unit, 5 mol % of a 1,4-cyclohexanedicarboxylic acid unit, and 5 mol % of an adipic acid unit) modified with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Example 4

A dyed napped artificial leather was obtained in the same manner as in Example 1 except that a PET (containing 1.7 mol % of a sulfoisophthalic acid tetrabutyl phosphonium salt unit and 3 mol % of an isophthalic acid unit) modified with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Example 5

A dyed napped artificial leather was obtained in the same manner as in Example 1 except that a PET (containing 1.7 mol % of a sulfoisophthalic acid tetrabutyl phosphonium salt unit and 6 mol % of an isophthalic acid unit) modified with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Example 6

A dyed napped artificial leather was obtained in the same manner as in Example 1 except that the mass ratio of the non-woven fabric to the aqueous polyurethane of the obtained artificial leather base material was changed to 80/20. Then, the obtained napped artificial leather was evaluated in the same manner as in Example 1. The results are shown in Table 1.

Example 7

A dyed napped artificial leather was obtained in the same manner as in Example 1 except that the mass ratio of the non-woven fabric to the aqueous polyurethane of the obtained artificial leather base material was changed to 75/25. Then, the obtained napped artificial leather was evaluated in the same manner as in Example 1. The results are shown in Table 1.

Example 8

A dyed napped artificial leather was obtained in the same manner as in Example 1 except that a PET (containing 1.7 mol % of a sulfoisophthalic acid tetrabutyl ammonium salt unit, 5 mol % of 1,4-cyclohexanedicarboxylic acid, and 5 mol % of adipic acid) modified with a sulfoisophthalic acid tetrabutyl ammonium salt was used as a thermoplastic resin serving as an island component. Then, the obtained napped artificial leather was evaluated in the same manner as in Example 1. The results are shown in Table 1.

Example 9

A dyed napped artificial leather was obtained in the same manner as in Example 1 except that the same thermoplastic resin serving as an island component as that used in Example 4 was used, and a multicomponent fiber spinning spinneret that could form a cross section on which 12 island component portions having uniform cross-sectional areas are distributed in the sea component was used.

Example 10

A dyed napped artificial leather was obtained in the same manner as in Example 1 except that the same thermoplastic resin serving as an island component as that used in Example 4 was used, a multicomponent fiber spinning spinneret that could form a cross section on which 12 island component portions having uniform cross-sectional areas are distributed in the sea component was used, and island-in-the-sea composite filaments having a fineness of 3.3 dtex were spun at a high speed.

Example 11

A dyed napped artificial leather was obtained in the same manner as in Example 1 except that a PET (containing 1.7 mold of a sulfoisophthalic acid tetrabutyl phosphonium salt unit) modified only with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Example 12

A dyed napped artificial leather was obtained in the same manner as in Example 1 except that a PET (containing 2.5 mol % of a sulfoisophthalic acid tetrabutyl phosphonium salt unit) modified only with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Comparative Example 1

A dyed napped artificial leather was obtained in the same manner as in Example 1 except that a PET (containing 4 mol % of a sulfoisophthalic acid tetrabutyl phosphonium salt unit, 5 mol % of a 1,4-cyclohexanedicarboxylic acid unit, and 5 mol % of an adipic acid unit) modified with a sulfoisophthalic acid tetrabutyl phosphonium salt was used as a thermoplastic resin serving as an island component. Then, the obtained napped artificial leather was evaluated in the same manner as in Example 1. The results are shown in Table 1.

Comparative Example 2

Island-in-the-sea composite filaments were spun in the same manner as in Example 1 except that a PET (containing 1.7 mol % of a sulfoisophthalic acid sodium salt unit, 5 mol % of a 1,4-cyclohexanedicarboxylic acid unit, and 5 mol % of an adipic acid unit) modified with a sulfoisophthalic acid sodium salt was used as a thermoplastic resin serving as an island component. However, the fibers were broken by the tension applied when the molten polymer discharged from the spinning nozzle was suctioned by the air jet nozzle with an air stream pressure regulated so as to provide an average spinning rate of 3700 m/min, while being cooled, so that melt-spinning was not performed in a stable manner. Accordingly, melt-spinning was performed at a low speed by reducing the pressure of the suction air. The subsequent steps were performed in the same manner as in Example 1, to obtain a dyed napped artificial leather. Then, the obtained napped artificial leather was evaluated in the same manner as in Example 1. The results are shown in Table 1.

Comparative Example 3

A napped artificial leather obtained in the same manner as in Example 1 was dyed into a red color by being immersed for 40 minutes in a dyeing bath at 90° C. containing 8% owf of a cationic dye "Nichilon Red-GL" (manufactured by NISSEI KASEI CO., LTD.; containing 4% of washable chlorine in the dye) as a dye and 1 g/L of 90% acetic acid as a dyeing aid at a liquor ratio of 1:30. Then, a step of washing the napped artificial leather using a hot water bath free of an anionic surfactant at 70° C. for 20 minutes was repeated twice in the same dyeing bath. Then, after washing, the napped artificial leather was dried, to obtain a dyed napped artificial leather.

Comparative Example 4

A napped artificial leather was obtained in the same manner as in Example 1 except that an isophthalic acid-modified PET (containing 6 mol % of an isophthalic acid unit) was used as a thermoplastic resin serving as an island component. Then, using Disperse Red-W, Kiwalon Rubine 2GW, and Kiwalon Yellow 6GF serving as a disperse dye, the napped artificial leather was jet-dyed for one hour at 130° C., and was subjected to reduction cleaning in the same dyeing bath, to obtain a dyed napped artificial leather. Then, the obtained napped artificial leather was evaluated in the same manner as in Example 1. The results are shown in Table 1.

Reference Example 1

A dyed napped artificial leather was obtained in the same manner as in Examples 1 except that the filament web was entangled under the following conditions in Example 1.

An oil solution mixed with an antistatic agent was sprayed to the surface of the obtained filament web, and thereafter, 10 sheets of the filament web were stacked by using a cross lapper apparatus to form a superposed web with a total basis weight of 340 g/m$^2$, and an oil solution for preventing the needle from breaking was further sprayed thereto. Then, the superposed web was needle-punched, thereby performing a three-dimensional entangling treatment. Specifically, the stack was needle-punched at a density of 2400 punch/cm$^2$ alternately from both sides by using 6-barb needles with a distance of 3.2 mm from the needle tip to the first barb at a punching depth of 8.3 mm. The area shrinkage by the needle punching was 18%, and the basis weight of the entangled web after the needle punching was 415 g/m$^2$.

Then, the obtained napped artificial leather was evaluated in the same manner as in Example 1. The results are shown in Table 1.

Referring to Table 1, all of the napped artificial leathers of Examples 1 to 12 according to the present invention had a tear strength per mm of thickness of 30 N or more and a peel strength of 3 kg/cm or more. Accordingly, all of the napped artificial leathers had a Martindale abrasion loss of 100 mg or less after 35000 times of rubbing. Furthermore, they also had a chlorine content of 90 ppm or less, and the results of the color migration evaluation were a grade 4 or more. Note that while Examples 1 to 10 exhibited excellent high-speed spinning stability during manufacture, Examples 11 and 12 exhibited inferior high-speed spinning stability On the other hand, the napped artificial leather of Comparative example 1, in which ultrafine fibers of a polyester containing 4 mol % of a unit represented by the formula (II), had a low tear strength and a low peel strength. Accordingly, it had a large Martindale abrasion loss. The napped artificial leather of Comparative example 2, in which ultrafine fibers of a polyester containing 1.7 mol % of a sulfoisophthalic acid sodium salt, also had a low tear strength and a low peel strength, and thus had a large Martindale abrasion loss. It also exhibited poor high-speed spinning stability during manufacture. The napped artificial leather of Comparative example 3, which was washed in a hot water bath free of an anionic surfactant during washing after dyeing with cation, had a high chlorine content, and was very poor in terms of the color migration. The napped artificial leather of Comparative example 4, which was dyed with a disperse dye, was also poor in terms of the color migration. In addition, although Reference example 1 exhibited excellent high-speed spinning stability during manufacture, it had a low tear strength and a low peel strength owing to a low entangled state, and thus had a large Martindale abrasion loss.

INDUSTRIAL APPLICABILITY

A napped artificial leather obtained by the present invention can be preferably used as a skin material for clothing, shoes, articles of furniture, car seats, general merchandise, and the like.

The invention claimed is:

1. A napped artificial leather dyed with a cationic dye, comprising:

a non-woven fabric of cationic dyeable polyester fibers having a fineness of 0.07 to 0.9 dtex; and an elastic polymer provided inside the non-woven fabric, wherein the cationic dyeable polyester fibers include a polyester containing a dicarboxylic acid unit mainly of a terephthalic acid unit and a glycol unit mainly of an ethylene glycol unit, and as a second dicarboxylic acid unit, 1.5 to 3 mol % of a unit represented by formula ($I_a$):

(Ia)

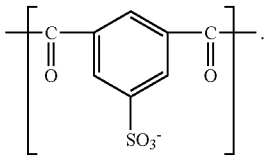

and wherein the napped artificial leather has

L* value≤50, a chlorine content of 90 ppm or less, a grade of color difference, determined in an evaluation of color migration to PVC under a load of 0.75 kg/cm at 50° C. for 16 hours, of 4 or more, a tear strength per mm of thickness of 30 N or more, and a peel strength of 3 kg/cm or more, wherein the tear strength is measured according to a method, wherein a test strip of 10 cm long by 4 cm wide is cut out from the napped artificial leather, then, a 5 cm-long cut is made at a center of a shorter side of the test strip, parallel to a longer side, then, using a tensile testing machine, a first and a second end opposite the first end of the test strip are nipped by a first and second chuck of a jig of the testing machine, and a stress-strain (s-s) curve is measured at a tensile speed of 10 cm/min.

2. The napped artificial leather according to claim 1, wherein the napped artificial leather has a Martindale abrasion loss (12 KPa) of 100 mg or less after 35000 times of rubbing.

3. The napped artificial leather according to claim 1, wherein the cationic dyeable polyester fibers are filaments.

4. The napped artificial leather according to claim 1, wherein the cationic dyeable polyester fibers have a glass transition temperature (Tg) in a range of 60 to 70° C.

5. The napped artificial leather dyed with a cationic dye according to claim 1, obtained by a process comprising:

dyeing, with a cationic dye, a napped artificial leather base material including a non-woven fabric of ultrafine fibers of 0.07 to 0.9 dtex of a cationic dyeable polyester and an elastic polymer provided inside the non-woven fabric, and having a napped surface at least on one surface thereof, wherein the cationic dyeable polyester contains a dicarboxylic acid unit containing mainly a terephthalic acid unit and 1.5 to 3 mol % of a unit represented by formula ($I_b$):

(Ib)

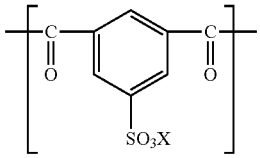

where X represents a quaternary phosphonium ion or a quaternary ammonium ion], and a glycol unit containing mainly an ethylene glycol unit, and the napped artificial leather has been subjected to a washing treatment in a hot water bath containing an anionic surfactant after being dyed with the cationic dye, and/or has a chlorine content of 90 ppm or less.

6. The napped artificial leather according to claim 5, wherein the cationic dyeable polyester contains greater than 0 to 0.2 mol % of a sulfoiosphthalic acid alkali metal salt unit.

7. The napped artificial leather according to claim 5, wherein the cationic dyeable polyester has a glass transition temperature (Tg) of 60 to 70° C.

8. A method for manufacturing the napped artificial leather dyed with a cationic dye according to claim 1, the method comprising:

preparing an artificial leather base material including a non-woven fabric of ultrafine fibers of 0.07 to 0.9 dtex of a cationic dyeable polyester and an elastic polymer impregnated into the non-woven fabric;

dyeing the artificial leather base material using a cationic dye, and thereafter washing the artificial leather base material in a hot water bath at 50 to 100° C. containing an anionic surfactant; and, either before or after the dyeing and washing, napping at least one surface of the artificial leather base material, wherein the cationic dyeable polyester includes a polyester containing a dicarboxylic acid unit mainly of a terephthalic acid unit and a glycol unit mainly of an ethylene glycol unit, and as a second dicarboxylic acid unit, 1.5 to 3 mol % of a unit represented by formula ($I_b$):

(Ib)

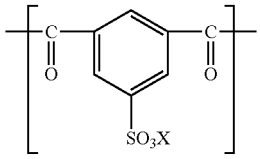

where X represents a quaternary phosphonium ion or a quaternary ammonium ion.

9. The method according to claim 8, wherein the cationic dyeable polyester contains greater than 0 to 0.2 mol % of a sulfoiosphthalic acid alkali metal salt unit.

10. The method according to claim 8, wherein the cationic dyeable polyester contains, a 1,4-cyclohexanedicarboxylic acid unit and an adipic acid unit each in a range of 1 to 6 mol %.

11. The method according to claim 8, wherein the cationic dyeable polyester contains an isophthalic acid unit in a range of 1 to 6 mol %.

12. The method according to claim 8, wherein the washing of the artificial leather base material in a hot water bath at 50 to 100° C. containing an anionic surfactant is performed to such an extent that a chlorine content is 90 ppm or less.

13. The method according to claim 8, wherein the preparing includes:

forming an ultrafine fiber-generating fiber entangled body including ultrafine fiber-generating fibers capable of forming the ultrafine fibers;

converting the ultrafine fiber-generating fibers into the ultrafine fibers to form a non-woven fabric of the ultrafine fibers; and impregnating an elastic polymer into the ultrafine fiber-generating fiber entangled body or the non-woven fabric of the ultrafine fibers.

14. The method according to claim 13, wherein the ultrafine fiber-generating fibers are filaments.

15. The method according to claim 13, wherein, in the forming of the ultrafine fiber-generating fiber entangled body, the ultrafine fiber-generating fibers are entangled to such an extent that a napped artificial leather having a tear strength per mm of thickness of 30 N or more and a peel strength of 3 kg/cm or more is obtained.

* * * * *